United States Patent [19]

Gueret

[11] Patent Number: 4,671,689

[45] Date of Patent: Jun. 9, 1987

[54] EYELASH MAKE-UP UNIT

[75] Inventor: Jean-Louis H. Gueret, Paris, France

[73] Assignee: L'Oreal, Paris, France

[21] Appl. No.: 721,423

[22] Filed: Apr. 9, 1985

[30] Foreign Application Priority Data

Apr. 11, 1984 [FR] France ..... 84 05731
Mar. 27, 1985 [FR] France ..... 85 04544

[51] Int. Cl.[4] ..... A45D 40/00; A45D 40/26; A46B 11/00

[52] U.S. Cl. ..... 401/122; 132/88.7; 401/121

[58] Field of Search ..... 401/121, 122; 132/88.5, 132/88.7

[56] References Cited

U.S. PATENT DOCUMENTS

| | | | |
|---|---|---|---|
| 3,130,735 | 4/1964 | Clark . | |
| 3,529,899 | 9/1970 | Gruska | 401/121 |
| 3,817,637 | 6/1974 | Vasas . | |
| 4,194,848 | 3/1980 | Kingsford | 401/122 X |
| 4,241,743 | 12/1980 | Schnabel et al. | 401/122 X |
| 4,403,624 | 9/1983 | Montgomery | 401/122 X |

FOREIGN PATENT DOCUMENTS

| | | | |
|---|---|---|---|
| 2722232 | 11/1978 | Fed. Rep. of Germany . | |
| 1436613 | 3/1966 | France . | |
| 1511770 | 2/1968 | France . | |
| 2098940 | 3/1972 | France . | |
| 612089 | 11/1960 | Italy | 401/122 |
| 465158 | 12/1968 | Switzerland . | |
| 2097662 | 11/1982 | United Kingdom | 401/122 |

*Primary Examiner*—Steven A. Bratlie
*Attorney, Agent, or Firm*—Cushman, Darby & Cushman

[57] ABSTRACT

This make-up unit comprises a reservoir for a make-up product e.g. mascara, a cap, and a stem terminated by a brush which penetrates into the reservoir by an opening bounded by a lip of a wiper element, an inlet duct being formed in a stopper. The internal and external openings of the duct have cross-sections which are respectively smaller than and larger than that of the brush in its state of rest. A stopper and the wiper element have a relative position which is variable between one configuration wherein the lip is spaced from the adjacent edge of the stopper to create an expansion chamber between them (for two successive wiping actions) and a second configuration wherein the said chamber is dispensed with and wherein, in one particular embodiment, the edge has penetrated into the opening edged by the lip and has moved the lip aside.

22 Claims, 7 Drawing Figures

EYELASH MAKE-UP UNIT

The present invention relates to a make-up unit, more particularly intended for the making up of lashes by means of a highlighting product for the lashes, also called mascara.

A conventional mascara applicator comprises a reservoir containing the mascara and a detachable cap intended to close the reservoir and which constitutes a handle for a brush which is carried by the end of a stem integral with the cap. In the closed position of the reservoir, the stem and its associated brush penetrate into the reservoir. When the stem is withdrawn from the reservoir, a certain quantity of mascara is taken up on the brush which may then be applied to the lashes.

The brush generally enters the reservoir via a substantially circular opening bounded by a single lip whose function is to exert a wiping action on the bristles of the brush with a view to eliminating excess make-up product taken up by the brush within the reservoir. The diameter of this circular opening must be smaller than the minimum diameter of the brush measured at the tips of the bristles so that the pliable lip bordering the opening can exert a wiping action on the brush during extraction from the reservoir. On the same occasion, the wiper lip wipes the part of the stem which enters the mass of make-up substance, on the assumption that the stem has a diameter at least equal to the external brush diameter.

The rapid release of the brush after passing the wiper lip may cause splattering of the product which is unpleasant for the user and clogs the opening of the mascara reservoir. To avoid this drawback it has been proposed in U.S. Pat. No. 4,403,624 that, after sustaining a first wiping action in the usual way by means of the pliable wiper lip, the brush should sustain a second wiping action by passing a second lip which is also pliable. Between the two wiping actions, the bristles of the brush resume their normal position in an expansion chamber which is thus arranged between the two wiper lips, so much so that the brush is ready to be wiped a second time in the best possible conditions.

This double wiping action is also found in German Offenlegungsschrift No. 2,722,232. In particular, in accordance with the embodiment of FIG. 5 of this German publication, the first wiping action is effected by means of a pliable lip and the second by the internal edge delimiting the opening of a relatively rigid annular opening disposed at the inlet to the reservoir for the product.

The drawback of the devices provided with a fixed volume expansion chamber derives from the fact that, in all cases, the brush sustains a relatively forceful wiping action because it is always effected twice over. Now it may be advantageous for the user to have the choice, at least between a stronger wiping action and a weak wiping action and thus to be able to contrive to take up an adjustable quantity of the product on the brush, depending on the nature of the lashes to be made up or upon her wishes.

For this purpose the present invention proposes a make-up unit of the above-mentioned type wherein a duct for the introduction of the brush carrier stem is arranged in a stopper carried by the reservoir and wherein it is possible to vary the distance between the conventional wiper element provided with its pliable lip and the adjacent end of the said stopper. The user will thus be able to choose, for instance, between two extreme positions, that is to say, one in which this distance is zero and the other in which this distance corresponds to the creation of an expansion chamber so that the wiping action is effected in two stages by virtue of the end of the stopper adjacent to the wiper lip constituting the second stage wiper.

The advantages of this double wiping action have been indicated above. It should be emphasised that the second wiping action makes it possible to avoid the deposit of the surplus make-up product on the brush after sustaining the first wiping action against the lower wall of the inlet duct, such product being liable to dry and to create a "chimney" against the wiper lip. Moreover, when the brush carrier stem is reintroduced into the container, if there is still a little of the product on the stem, the stem is unlikely to be brought back to the bottom of the inlet duct; it will remain in the space situated between the first and second wiping zones and will be trapped at the second wiping action during the subsequent use of the make-up unit. Finally, when the stem is reintroduced into the reservoir after use, any possible spattering of the product remaining on the brush, in a direction along the stem, produced by the compression of the air contained in the reservoir, will occur in the above-mentioned space and no longer at the bottom of the inlet duct, in which case, the product remaining in this space will also be trapped at the second wiping action during the next use.

In the case where the expansion chamber is dispensed with, provision can be made in accordance with a first embodiment for the stopper to be capable of coming to bear, at its lower end, against the pliable lip, in which case the wiping action will be effected by the lower end and by the rigid internal edge of the stopper without any transitional stage. Likewise, one may even make provision in a second embodiment for the wiping action to be effected only by the bottom edge of the stopper on condition that the latter can penetrate through the opening delimited by the pliable wiper lip and produce the complete retraction of the latter. This second embodiment does thus offer the user the possibility of a weaker wiping action than is available with the preceding embodiment because it uses only the bottom edge of the stopper as a wiper. The user could even, in the case of this second embodiment have the choice, in the case where the expansion chamber is dispensed with, between a wiping action effected solely by the bottom edge of the stopper and a wiping action effected in the same manner as in the previously mentioned embodiment.

Specifically, the present invention provides a make-up unit comprising a reservoir for a fluid or pasty make-up product; a detachable cap fitted on the reservoir; a stem integral with and substantially coaxial with said cap and projecting in relation to the said cap; a brush as an extension of the said stem and carried by that end of the stem which is remote from the cap, said brush penetrating inside the reservoir through an opening edged by a lip of a wiper element, said opening having, when the lip is in its relaxed state, a smaller cross-section than that of the brush in its relaxed state; a stopper carried by the reservoir and disposed on the side of the lip of the wiper element where there is no make-up product; an inlet duct in said stopper, the longitudinal axis of the said inlet duct being substantially identical with the axis of said opening through which the brush penetrates into the reservoir, the opening of said inlet duct furthest removed from the wiper element having a larger cross-section than that of said brush in its relaxed state, said stopper and said wiper element having a relative positioning which is variable between a first configuration in which said wiper element is in contact with the adjacent end of said stopper and a second configuration in which the lip of said wiper element is spaced from the adjacent end of said stopper to define an expansion chamber between these two members, the opening of the inlet duct which is nearest to the wiper element having a cross-section smaller than that of said brush in its relaxed state.

In a first embodiment of make-up unit according to the invention, the wiper element is fixed and the stopper is movable in relation thereto.

The stopper is advantageously attached in a leak-proof manner on the opening of the reservoir wherein the brush is introduced.

The wiper element may comprise a sleeve which holds it in position within the reservoir. It is advantageous for the sleeve to be tightly engaged at the upper part of the reservoir and to have an external fastening flange on said reservoir, the stopper being sealingly slidably mounted in said sleeve.

The wiper element may comprise an annular washer whose inner edge forms the wiper lip. If provision has been made for the wiper element to be carried by a sleeve, the wiper element is then advantageously constituted by a cylindrical sleeve of the same diameter as is the reservoir whose base is formed by the annular washer supporting the wiper lip.

In the case where the wiper element is fixed, it is advantageous, while the stopper is movable, for the said stopper to be slidable in relation to the opening of the reservoir with which it cooperates, the part projecting outside the reservoir comprising a stop capable of abutting against an external bearing surface integral with the reservoir, to limit the displacement of the stopper in the direction corresponding to its extraction from the reservoir. In that case, it is preferable for said bearing surface fixed to the reservoir to be constituted by an external edge of a supporting flange of the sleeve on the opening of the reservoir, the stopper sliding sealingly within said sleeve. Preferably, the stop carried by the stopper is constituted by at least one protuberance of the internal wall of a collar surrounding the upper part of the reservoir and attached to the part of the stopper projecting out of the reservoir. Advantageously, the part of the stopper sliding in the reservoir, the collar, and the upper part of the reservoir all have a circular cross-section, the said upper part of the reservoir carrying externally a plurality of axial grooves each of which is capable of accommodating a protuberance of the collar.

If the wiper element is fixed and the stopper is movable in relation to the said wiper element, the make-up unit advantageously comprises means for indicating to the user each of the two configurations of the stopper in relation to the wiper element. If provision has been made for a collar surrounding the upper part of the reservoir, as indicated above, the aforementioned indicator device advantageously consists of at least one pointer carried by the collar and capable of coming opposite marks carried by the external wall of the reservoir.

If provision has been made for a stopper sliding in relation to the opening of the reservoir, it is advantageous for this stopper to comprise, near its end remote from the wiper element, means complementary to means carried by the cap to ensure fastening of the cap on the reservoir.

The wiper lip is advantageously a pliable and elastically deformable lip.

In a first embodiment, the lip has a frusto-conical shape narrowing towards the reservoir phase. In a second embodiment, it is formed by the internal edge of an annular washer disposed in a plane perpendicular to the axis of the opening through which the brush penetrates into the reservoir.

Moreover, the wiper lip may have at least one radial slot. In particular, provision may be made for the wiper lip to have a plurality of substantially identical radially extending and regularly interspaced slots on the internal edge of the said lip.

Moreover, the opening bounded by the wiper lip may have a cross-section which is equal to or slightly smaller than that of the stem which allows the wiper lip to ensure also the wiping of the portion of the stem which has been in contact with the contents of the reservoir.

The inlet duct may be frusto-conical.

In the above-mentioned first configuration of the stopper and the wiper element, the free lip of the stopper may be capable of penetrating into the opening bounded by the wiper lip so as to push aside the wiper lip. In this configuration the user will obtain a wiping action solely by this rigid edge of the stopper. It may then be useful for the stopper to have an external cross-section which progressively diminishes towards the wiper lip to make it easier for the free edge of the stopper to pass through the above-mentioned opening.

In order that the present invention may be more readily understood, there will be described below two embodiments given by way of purely illustrative and non-restrictive examples, with reference to the accompanying drawings, in which.

FIGS. 1 to 4 show a make-up unit 201 used for the application of mascara to eyelashes. In the closed position seen in FIG. 1, the unit 201 takes the form of a cylindrical stick whose lower portion is constituted by a cylindrical mascara reservoir 202 and whose upper part is formed by a cap 203 which is also cylindrical with substantially the same diameter as reservoir 202.

Reservoir 202 may, for instance, be formed of polypropylene by moulding, injection moulding, injection blow moulding or by extrusion blow-moulding, or of polyvinyl chloride by blow moulding.

Figure 1:
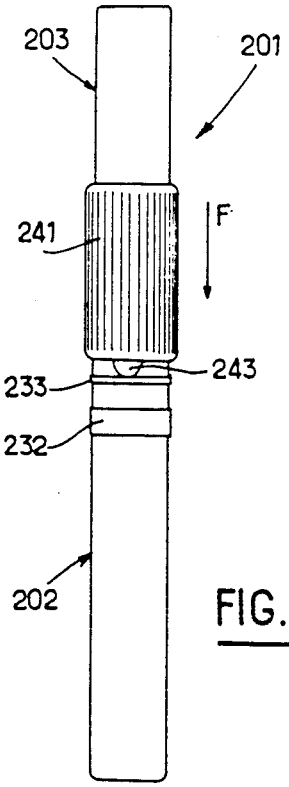
FIG. 1 is an elevational view of a make-up unit in accordance with the above-mentioned first embodiment.
Figure 2:
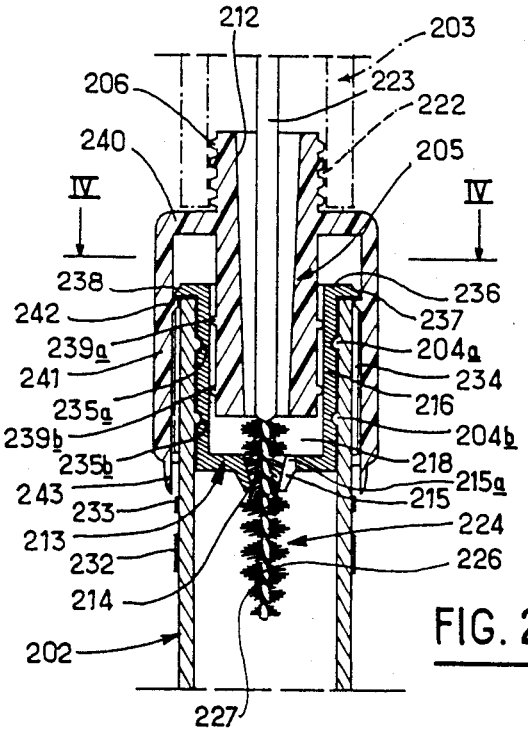
FIGS. 2 and 3 are partial axial cross-sectional views of the unit of FIG. 1 showing the upper part of the reservoir, the stopper being represented in its high and low positions, respectively, and the brush carrier stem being represented in a position where it is in the course of extraction from the reservoir.

In its upper zone, the reservoir 202 comprises two marks 232, 233 one above the other, these marks being obtained by marking the external surface of the reservoir 202 with rings by hot stamping or serigraphy, conforming to the ring constituting the lower mark 232 having a greater depth than that constituting the upper mark 233. Moreover, near its upper edge, reservoir 202 carries internally two peripheral beads 204*a*, 204*b* (FIG. 2).

Between its end edge and the vicinity of the second mark 233, the external wall of reservoir 202 comprises a plurality of axial grooves 234 (FIGS. 2 to 4) regularly interspaced at the periphery of the reservoir 202, the function of these grooves 234 being described below.

At the opening of reservoir 202 is an inner cylindrical sleeve 216 on whose external wall are two annular grooves 235*a*, 235*b* to cooperate with the beads 204*a*, 204*b* of reservoir 202. Sleeve 216 extends radially outwardly at right angles at its upper part so as to constitute an annular flange 236 resting on the rim of reservoir 202, this flange 236 projecting beyond the reservoir rim so as to constitute an annular bearing surface 237 at the rim. Moreover, the external edge 238 of this flange 236 has a chamfer so as to be flared towards reservoir 202.

At its lower portion the sleeve 216 is connected to a wiper element generally designated 213. This element 213 is constituted by an annular washer whose circular opening 214 is bounded, on the outer face of the sleeve 216, by a pliable wiper lip 215 having a frusto-conical shape narrowing towards the bottom of reservoir 202 and comprising an axial slot 215*a* disposed in a radial plane and intended to give the lip 215 more flexibility.

Within the sleeve 216 is a slidable stopper 205, for instance obtained by moulding of polypropylene, having a cylindrical tubular body whose internal frusto-conical wall flares outwardly and defines an inlet duct 212 whose longitudinal axis is substantially identical with the axis of the outer side of stopper 205.

The smallest diameter of duct 212 is smaller than the minimum diameter of the brush 224 in its relaxed state and is substantially equal to that of the opening 214.

In its lower zone the stopper 205 has two external peripheral sealing rings 239*a*, 239*b*. Alternatively it is possible to obtain this seal between stopper 205 and sleeve 216 by beads on the internal wall of the said sleeve 216, in which case the corresponding outer face of the stopper 205 would be smooth.

Near its upper end, the stopper 205 carries an external thread 206 intended to cooperate with a corresponding thread 222 carried by the cap 203, with a view to fitting the cap 203 on the reservoir 202.

In its portion projecting above the reservoir 202, stopper 205 has, below the thread 206, an annular flange 240 carrying peripherally a cylindrical collar 241 which surrounds the upper portion of the reservoir 202 in the closed configuration. This collar 241 carries internally four protuberances 242 spaced at 90° from each other; these protuberances 242 have a flat top surface which is substantially perpendicular to the internal wall of the collar 241 and an inclined bottom side having the same orientation as the edge 238 of the flange 236 of the sleeve 216.

When the stopper 205 is mounted on reservoir 202, these protuberances 242 are intended to be located in grooves 234 of the reservoir 202 to prevent the stopper 205 from rotating in relation to the reservoir 202.

Moreover, collar 241 has along its lower edge two opposite pointers whose function will be indicated below.

Figure 5:
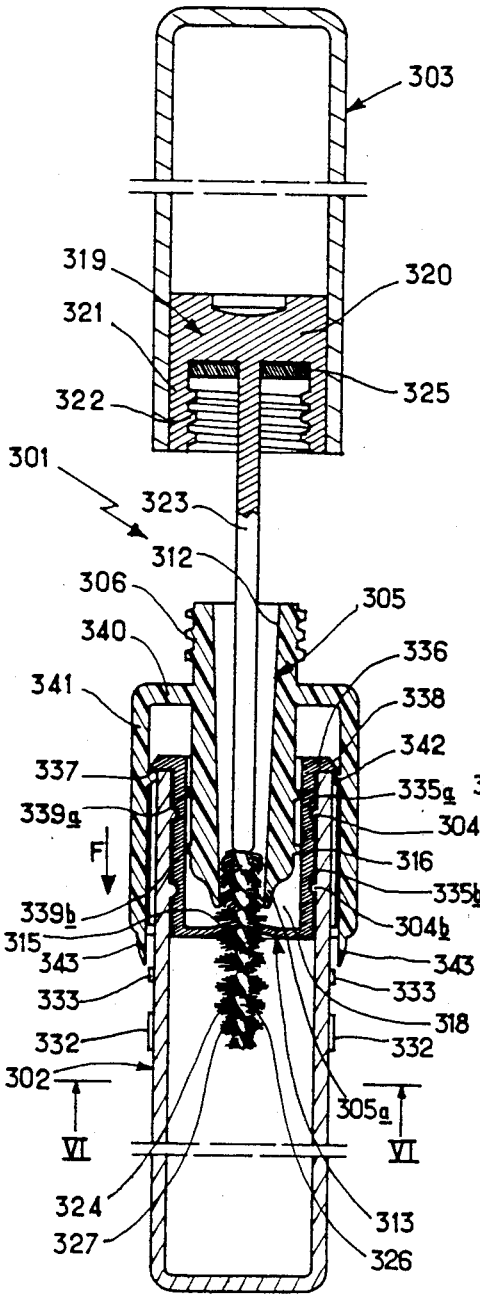
FIG. 5 is a partial cross-section of a make-up unit according to the above-mentioned second embodiment, the cap being shown in a position where the brush carrier stem associated with it is in course of extraction from the reservoir and the stopper being shown in its uppermost position.
Figure 6:
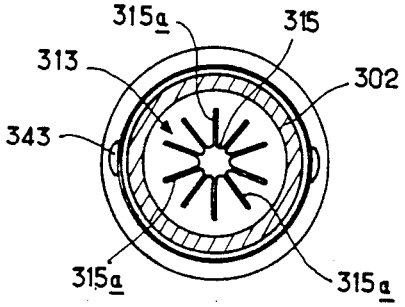
FIG. 6 is a cross-sectional view along line VI—VI of FIG. 5.
Figure 7:
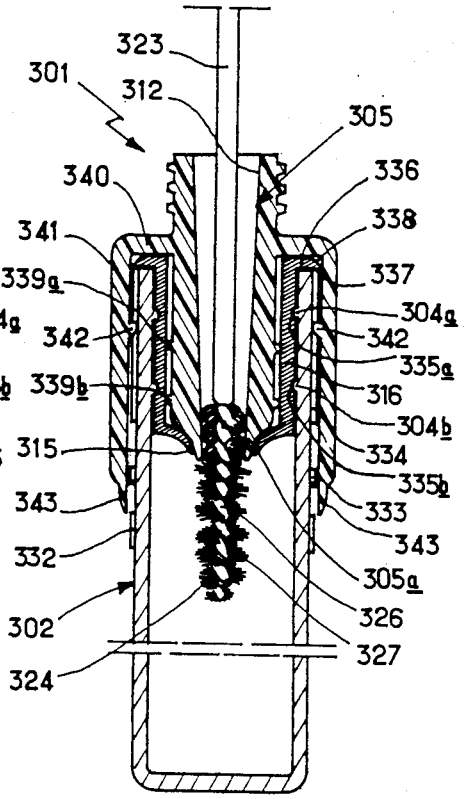
FIG. 7 is a view similar to FIG. 5, only showing the reservoir and the brush carrier stem, the stopper being shown in its lowermost position.

Cap 203 has a structure similar to that of the cap 303 of the make-up unit of FIGS. 5 to 7, and it is provided with a stem 223 carrying a brush 224 similar to the stem 323 and brush 324 of this unit of FIGS. 5 to 7. Those components of FIGS. 5 to 7 which have identical counterparts have a reference numeral increased by 100.

Thus, referring to FIG. 5, it can be seen that cap 303 comprises internally a capsule 319 which is force-fitted in the opening of the cap 303. This capsule 319 consists of a main body 320 having a cylindrical external wall which is extended by a skirt 321 which abuts the internal adjacent side of the opening of cap 303, the free edge of the said skirt 321 being level with that of the cap 303. This skirt 321 has an internal thread 322 intended to cooperate with external threading 306 carried by the stopper.

Within and coaxial with capsule 319 is a stem 323 which is integral with the capsule 319. This stem 323 projects outside the cap 303 and ends in a brush 324 which, in the closed position of the make-up unit, projects into the reservoir 302. In this position the end of the brush 324 remote from the stem 323 arrives in position near the bottom of the reservoir 302. It will be seen that the presentation cap 303 forms a handle allowing the brush 324 to be easily manipulated.

An annular seal 325 disposed against the annular inner face of the body 320 of the capsule is accessible from the opening of the cap 303.

The cross-section of the stem 323 is equal to, or slightly greater than, the cross-section of the opening bounded by the free edge 315 of the wiper lip. On the other hand, the stem cross-section is smaller than the cross-section of the opening of the base of stopper 305. The above described components of the embodiment of FIGS. 5 to 7 are identical to the corresponding parts of FIGS. 1 to 4, but are illustrated more clearly in the later Figures.

Brush 224 is constituted by a core 226 which is coaxial with the axis of stem 223. The core 226 is formed by folding a metallic wire back on itself, and then twisting this wire, doubled in this way so as to trap a helical arrangement of radial bristles 227 around core 226. The minimum diameter of the brush 224, in its relaxed state, measured at the tips of the bristles 227 is greater than the internal diameter of the lip 215 measured at its free lower end. Moreover, it has been seen that it is also greater than the diameter of the lower opening of stopper 205.

The assembly of the device according to this first embodiment is extremely simple, since it is sufficient to introduce sleeve 216 into the opening of the reservoir 202 until the flange 236 engages the upper edge of the said reservoir 202. In this position, the beads 204*a*, 204*b* have entered the corresponding grooves 239*a*, 239*b*.

Subsequently, the stopper 205 is presented above reservoir 202 and is introduced into the sleeve 216. The protuberances 242 are forced past the flange 236, which is facilitated by the profile of the edge 238 of the flange 236 and by the profile of the protuberances 242, each enters a groove 234 of the reservoir 202. At this moment, the stopper can only slide by way of axial translation, the protuberances 242 being guided in the grooves 234. The stopper can then occupy the position of FIG. 3 where it is in contact with the wiper element 213 and where it is only possible to effect a single wiping action of the brush 224 by means (a) of the pliable lip 215 and (b), without transition, by the rigid internal edge of the base of stopper 205.

In the position of FIG. 2, the beads 242 bear against the bearing surface 237 and there is formed an expansion chamber 218. The wiping operation is then as follows:

When the brush 224 is being extracted from the reservoir 202, it sustains a first wiping action by the pliable lip 215 and then, having regained its normal dimensions in the expansion chamber 218, it undergoes a second wiping action by the inner edge of the bottom of stopper 205. FIG. 2 shows an intermediate position of the brush 224, as the bristles 227 of brush 224 are regaining their relaxed state in the chamber 218.

The wiping of the brush 224 is more pronounced than in the preceding position of stopper 205 because it takes place twice over. In these conditions, after use the user reintroduces the brush carrier stem which does not carry any excess of mascara. Moreover, when the user reintroduces the stem 223 into the reservoir 202, should the occasion arise, any product possibly remaining on stem 223 near the brush 224 is returned into the chamber 218 without reaching the bottom of duct 212, by the lip 215. Moreover, at the time when stem 223 is reintroduced into the reservoir 202, the possible ascent of splatterings along stem 223 of mascara remaining on the brush 224, which occurs to the extent that the air of reservoir 202 is compressed by brush 224, will only take place in the chamber 218 and not at the base of the duct 212. The product remaining for one reason or another in chamber 212 is necessarily trapped at the second wiping action of the subsequent use.

Figure 3:
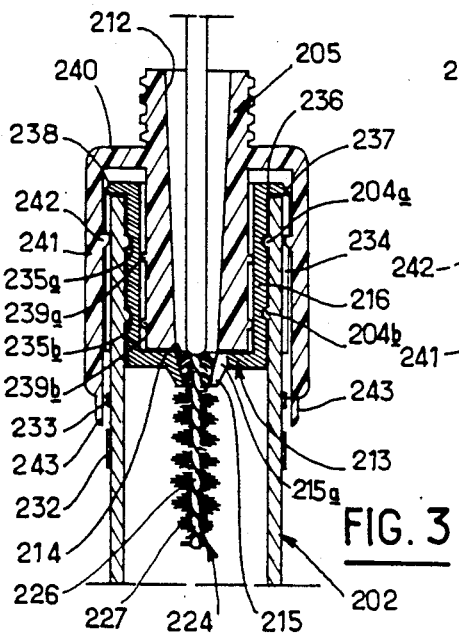
Figure 4:
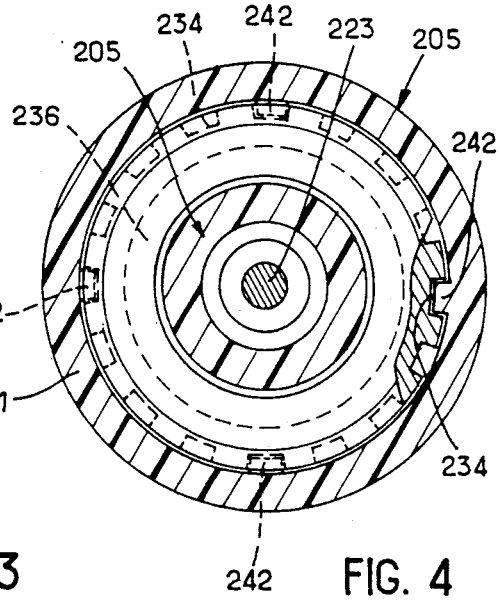
FIG. 4 is a cross-sectional view along line IV—IV of FIG. 2 on an enlarged scale.

In the FIG. 3 position, the pointers 243 are placed in front of the lower mark 232 which is constituted by the wider band to indicate a heavier make-up action following weak wiping. In the FIG. 2 position, the pointers 243 are placed in front of the upper mark 233 constituted by a narrow band to signify a finer make-up action following pronounced wiping. The user can thus choose between the two positions according to individual need, by simply displacing the collar 241 along the direction of arrow F in FIG. 1.

If reference is now again made to FIGS. 5 to 7, there will be seen a second embodiment of the invention. As explained above, the corresponding elements of this unit are marked by reference numerals increased by 100 in comparison with the numerals used to designate the corresponding elements of the unit of FIGS. 1 to 4.

The unit according to this second embodiment differs from the first embodiment by, on the one hand, the structure of the wiper lip 313 and by, on the other hand, the structure of the inner end of the stopper 305.

The wiper device 313 is constituted by a radial annular washer whose internal edge constitutes a wiper lip 315. This latter has a plurality of radial slots 315*a* which are all identical and regularly interspaced on the periphery of the opening delimited by the lip 315 (FIG. 6).

In the state of rest of this lip 315, the said opening has a smaller diameter than the minimum diameter of brush 324 in its free state.

As for the stopper 305 it has, near the lip 315, an external cross-section which progressively decreases towards the lip 315. There is thus constituted, for the stopper 305, a free tapered edge 305*a* whose function is indicated below.

The operation of the unit of FIGS. 5 to 7 is similar to that of the unit of FIGS. 1 to 4, with the exception that, in the extreme position of FIG. 7, the rigid lower free edge 305*a* of the stopper 305 has entered the opening delimited by the pliable lip 315, this lip being pushed aside as facilitated by the presence of slots 315*a*. In these conditions, the user will obtain a less pronounced wiping than that which was obtained with a similar relative position of the stopper 205 and the wiper lip 213 of the unit of FIGS. 1 to 4, because the wiper is here constituted solely by the internal edge 305*a* of the stopper 305.

It shall be duly understood that the embodiments described above are in no way restrictive and may give rise to any desirable modifications without departing from the scope of the invention as defined in the claims. In particular, the bearing surface 237, 337 can, instead of being constituted by a projection of the annular flange 236, 336 which bears on the free edge of the reservoir 202, 302, be constituted by a stop ring moulded externally on the lateral external wall of the reservoir 202, 302, just below the level of flange 236, 336, in which case, it is no longer necessary for the flange 236, 336 to project in relation to the external lateral wall of reservoir 202, 302. Provision may also be made in the second embodiment for an intermediate position of the stopper 305 in which its edge 305*a* would just come to bear on the lip 315, this position corresponding to a wiping action of the type obtained in the similar position of the stopper 205 in relation to the lip 215 in the unit of the above-mentioned first embodiment.

I claim:

1. In a make-up unit, comprising a reservoir for a fluid or pasty make-up product; wiper lip means defining an opening to said reservoir; a detachable cap fitted on the reservoir; a stem integral with and substantially coaxial with said cap and projecting in relation to the said cap; a brush as an extension of the said stem and carried by that end of the stem which is remote from the cap, said brush penetrating inside the reservoir through said opening edged by said wiper lip means, said opening having, when the lip is in its relaxed state, a smaller cross-section than that of the brush in its relaxed state; a stopper carried by the reservoir and disposed on the side of the lip of the wiper lip means where there is no make-up product; an inlet duct in said stopper, said inlet duct having a longitudinal axis substantially coincident with the axis of said opening through which the brush penetrates into the reservoir; a first end opening of said inlet duct, said first end opening being remote from the wiper lip means and having a larger cross-section than that of said brush in its relaxed state; the improvement comprising means for varying the relative positioning of said stopper and wiper lip means between a first position in which said wiper lip means is in contact with a first adjacent end of said stopper and a second position in which said wiper lip means is spaced from said first end of said stopper to define an expansion chamber between these two members, the second end opening of the inlet duct which is nearest to the wiper lip means having a cross-section smaller than that of said brush in its relaxed state; said stopper having a base and an internal border at said base the arrangement being such that when said stopper is in the said first position, the brush is subjected to a single wiping by said wiper lip means whereas when in the said second position the brush is subjected to a first wiping by the flexible lip and is then returned to its normal dimension in the expansion chamber followed by a second wiping by the internal border at the base of the stopper; said stopper being slidably mounted in relation to the opening of said reservoir with which it cooperates for movement between points corresponding to said first and second positions, said stopper having a projection which extends inwardly, said reservoir having an integral external bearing surface engageably by said projection for limiting the displacement of said stopper when said stopper is moved in a direction corresponding to extraction of said stopper from said reservoir; said make-unit including a collar which surrounds the upper portion of said reservoir, said collar being attached to a portion of said stopper which projects outside said reservoir, said collar having an internal wall and said projection being located on said internal wall of said collar.

2. A make-up unit according to claim 1, wherein the wiper lip means is fixed in position and the stopper is movable in relation thereto between first and second positions.

3. A make-up unit according to claim 1, wherein said stopper is attached in a leak-proof manner on the opening of the reservoir at which the brush is introduced.

4. A make-up unit according to claim 1, and including a sleeve inside the reservoir, said wiper lip means is held by said sleeve.

5. A make-up unit according to claim 4, wherein the sleeve carrying the wiper lip means is fixedly attached to the reservoir.

6. A make-up unit according to claim 5, wherein said sleeve is tightly engaged at the upper portion of the reservoir and has an external flange for attachment to the said reservoir, said stopper being sealingly slidably mounted in said sleeve.

7. A make-up unit according to claim 1, wherein the wiper lip means comprises an internal edge of an annular washer.

8. A make-up unit according to claim 7, wherein the wiper lip means is part of a cylindrical sleeve coaxial with the reservoir, said sleeve having an end formed by the annular washer supporting the wiper lip means.

9. A make-up unit according to claim 7, wherein the wiper lip means is formed by the inner edge of the annular washer which is disposed in a place perpendicular to the axis of the opening through which the brush enters the reservoir.

10. A make-up unit according to claim 1, including a sleeve on the opening of the reservoir, said sleeve including a supporting flange, and wherein said integral bearing surface of the reservoir is constituted by the external edge of said supporting flange of the sleeve, the stopper being sealingly slidable in said sleeve.

11. A make-up uunit according to claim 2, wherein it comprises means for indicating to the user each one of the two positions of stopper in relation to the wipe lip means.

12. A make-up unit according to claim 1, wherein the portion of stopper slidable in the reservoir, the collar and the upper portion of reservoir all have a circular cross-section, said upper portion of reservoir carrying externally a plurality of axial grooves each of which is capable of accomodating one said protuberance of the collar.

13. A make-up unit according to claim 1, including indicating means consisting of the at least one pointer carried by said collar and capable of coming opposite marks on the external wall of the reservoir, to indicate said first and second positions of said stopper.

14. A make-up unit according to claim 4, wherein the stopper comprises, near its second end which is remote from the wiper lip means, means for receiving a cap for fitting the cap on the reservoir.

15. A make-up unit according to claim 1, wherein the wiper lip means is a pliable and elastically deformable lip.

16. A make-up unit according to claim 1, wherein the wiper lip means has a frusto-conical shape narrowing towards the bottom of the reservoir.

17. A make-up unit according to claim 1, including means defining at least one radial slot in the wiper lip means.

18. A make-up unit according to claim 17, including a plurality of radial slots in the wiper lip means, said slots being substantially identical and regularly interspaced around an internal edge of said wiper lip means.

19. A make-up unit according to claim 1, wherein said opening delimited by the wiper lip means has a cross-section equal to, or slightly smaller than, that of said stem.

20. A make-up unit according to claim 1, wherein the inlet duct is frusto-conical.

21. A make-up unit according to claim 1, wherein, in said first configuration of the stopper and the wiper lip means, the free edge of the stopper is capable of penetrating into said opening bounded by the wiper lip means so as to move said wiper lip means aside.

22. A make-up unit according to claim 21, wherein said stopper has an external cross-section which progressively decreases towards the wiper lip means.

* * * * *